US010943423B2

(12) United States Patent
Robitaille

(10) Patent No.: US 10,943,423 B2
(45) Date of Patent: Mar. 9, 2021

(54) AUTONOMOUS CASH BOX AND PAYMENT TERMINAL RECEIVING THE AUTONOMOUS CASH BOX

(71) Applicant: Cyril Robitaille, La Prairie (CA)

(72) Inventor: Cyril Robitaille, La Prairie (CA)

( * ) Notice: Subject to any disclaimer, the term of this patent is extended or adjusted under 35 U.S.C. 154(b) by 0 days.

(21) Appl. No.: 16/676,667

(22) Filed: Nov. 7, 2019

(65) Prior Publication Data

US 2020/0143619 A1 May 7, 2020

Related U.S. Application Data

(60) Provisional application No. 62/756,965, filed on Nov. 7, 2018.

(51) Int. Cl.

| | |
|---|---|
| ***G07D 11/00*** | (2019.01) |
| ***G07D 11/125*** | (2019.01) |
| ***G07D 11/20*** | (2019.01) |
| ***G07D 11/40*** | (2019.01) |

(52) U.S. Cl.
CPC ..... *G07D 11/20* (2019.01); *G07D 11/0093* (2013.01); *G07D 11/40* (2019.01)

(58) Field of Classification Search
CPC ..... G07D 11/0093; G07D 11/125
USPC ..... 235/379
See application file for complete search history.

(56) References Cited

U.S. PATENT DOCUMENTS

| | | | | |
|---|---|---|---|---|
| 2009/0057094 | A1* | 3/2009 | Nireki | B65H 9/101 194/206 |
| 2011/0111866 | A1* | 5/2011 | Anthony | G07F 9/06 463/46 |
| 2016/0110939 | A1* | 4/2016 | Dobbins | E05B 47/0696 70/263 |

* cited by examiner

*Primary Examiner* — Toan C Ly
(74) *Attorney, Agent, or Firm* — BCF LLP

(57) ABSTRACT

An autonomous cash box for use in a payment terminal comprises an enclosure and a top portion mounted to the enclosure. The top portion has a displaceable lid. An electric motor and a control unit are mounted within the enclosure. The control unit is configured to activate the electric motor to selectively displace the lid to open or close the top portion of the autonomous cash box. A payment terminal receives the autonomous cash. Commands to open or close the lid may be sent from a wireless transmitter in the payment terminal and received at a wireless receiver of the autonomous cash box.

20 Claims, 17 Drawing Sheets

AUTONOMOUS CASH BOX AND PAYMENT TERMINAL RECEIVING THE AUTONOMOUS CASH BOX

CROSS-REFERENCE

The present application claims priority from U.S. Provisional Patent Application No. 62/756,965, filed on Nov. 7, 2018, the entirety of which is incorporated herein by reference.

TECHNICAL FIELD

The present disclosure relates to the field of cash boxes and similar structures for receiving, storing and transporting coins and bills. More specifically, the present disclosure relates to an autonomous cash box and to a payment terminal adapted to receive the autonomous cash box.

BACKGROUND

Cash boxes are commonly used in buses and in other means of mass transportation for collecting monies from users that prefer to pay their fares in cash. FIG. 1 (prior art) is a perspective view of a payment terminal installed in a bus or like vehicle. A payment terminal 10 comprises a payment interface 12 mounted on top of a pedestal 14. Users mounting on a bus have a choice of making an electronic payment by approaching a transit card (not shown) near an RFID receiver (not shown) hidden underneath a panel 16 that illustrates a shape and logo of a transit card emitted by a local transit authority, which is an OPUS™ logo in the particular case of FIG. 1. Alternatively, users may pay the fare by inserting coins in a coin slot 18 and/or by inserting bills in a bill slot 20. An electronic display 22, visible from a position of a bus driver, provides a visual indication that access to the bus is accepted, or not, by the payment terminal 10. Buttons 24 are used by the bus driver to control various functions of the payment terminal 10.

Coins and bills inserted in the slots 18 and 20 fall into a cash box (FIG. 2) mounted within an internal space of the pedestal 14. The pedestal 14 has a front door 26, which is usually provided with a lock, for mounting and dismounting the cash box from the payment terminal 10. Other internal components (not shown) of the payment terminal 10 include, for example, a power supply, a processor, and sensors that detect coins and bills inserted in the slots 18 and 20.

Although electronic payment is increasingly used by travelers to pay bus fares, there is still a very significant number of users that prefer to use cash to pay bus fares. Considerable sums are inserted every day in cash boxes that, for that reason, should be protected by strong anti-theft mechanisms.

Some earlier cash boxes include conventional locking mechanisms that may be unlocked using a key. These cash boxes are not considered sufficiently secure for most applications.

FIG. 2 (prior art) is a perspective view of a conventional cash box mounted within the payment terminal of FIG. 1. A cash box 30 comprises an enclosure 32 having four (4) sides, a bottom, and a closeable top 34. Within the enclosure 32, an internal separator wall 36 divides an internal volume of the enclosure 32 into a coin receiving part 38 and a bill receiving part 40. The coin and bill receiving parts 38 and 40 are respectively positioned underneath the coin and bill slots 18 and 20 when the cash box 30 is installed inside the pedestal 14 of the payment terminal 10. In the present description of FIG. 2, a front panel 41 of the cash box 30 is visible when opening the front door 26 of the pedestal 14 in which the cash box 30 is installed. The terms 'front' and 'rear' as applied to other elements of the cash box 30 follow the same orientation.

The top 34 of the cash box 30 is open, as illustrated on FIG. 2, when the cash box 30 is installed inside the pedestal 14. The top 34 may be closed as follows: A slideable carrier 42 is shown in a resting position on FIG. 2, a front-end of the slideable carrier 42 abutting against a fixed plate 44 of the top 34. To close the top 34, the slideable carrier 42 is moved away from the fixed plate 44, sliding toward a rear side 45 of the cash box 30, dragging behind it a plurality of curtain plates (not shown) that are guided by rails 46 on the separator wall 36 and on the inside of the enclosure 32. The curtain plates fill a space left between fixed plate 44 and the slideable carrier 42 when the slideable carrier 42 is abutting against the rear side 45. Motorized means (not shown) integrated within the payment terminal 10 are used to displace the slideable carrier 42. When the top 34 is securely closed, the payment terminal 10 releases the cash box 30 that can be pull out from the pedestal 14 by opening the front door 26 and pulling on a handle 48.

The cash box 30 has a very sturdy construction to prevent unauthorized access, a consequence of this being that the cash box 30 tends to be quite heavy. However, despite its sturdy construction, the cash box 30 frequently suffers from mechanical failures due to its large number of internal components and requires significant maintenance.

The customary manner of opening the cash box 30 to withdraw the money stored therein consists of mounting the cash box 30 upside down to a separate device, or vault (not shown), arranged to cause opening of the top 34 so that the monies may fall within the vault. The sheer weight of the cash box 30 renders this task quite difficult.

Generally, a transit authority managing hundreds of buses may have a single one of these vaults. Cash boxes are emptied in the vault on a daily basis. If a given cash box is broken, the transit authority would normally have a number of spare units that may be mounted on a bus to replace a broken unit. However, the transit authority may have a limited number of vaults capable of opening the cash boxes, at least because managing a large number of vaults could lead to a greater risk of having one of these vaults being used for stealing the monies out of cash boxes. As a result, if one of the limited number of vault breaks, the transit authority may be unable to open some of its cash boxes for an extended period of time. A full cash box cannot be practically used in a bus because it cannot receive any more money.

Therefore, there is a need for improvements to the collection of monies in buses and other means of mass transportation that compensate for problems related securely receiving, storing and transporting coins and bills and, more particularly, to the difficult management and handling of cash boxes.

SUMMARY

According to the present disclosure, there is provided an autonomous cash box for use in a payment terminal. The autonomous cash box comprises an enclosure, a top portion, an electric motor and a control unit. The top portion is mounted to the enclosure and has a displaceable lid. The electric motor and the control unit are mounted within the enclosure. The control unit is operatively connected to the electric motor. The control unit is configured to activate the electric motor to selectively displace the lid to open or close the top portion of the autonomous cash box.

According to the present disclosure, there is also provided a payment terminal. The payment terminal comprises a pedestal having a door giving access to an internal space of the pedestal. The internal space is adapted for receiving the autonomous cash box. The payment terminal also comprises a payment interface mounted on top of the pedestal and adapted for receiving a cash payment. The payment interface and the internal space of the pedestal are sized and configured so that the cash payment received at the payment interface falls into the open top portion of the autonomous cash box when received in the pedestal.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which.

Like numerals represent like features on the various drawings.

DETAILED DESCRIPTION

Various aspects of the present disclosure generally address one or more of the problems related to securely receiving, storing and transporting coins and bills and, more particularly, to the difficult management and handling of cash boxes.

In an aspect of the present technology, an autonomous cash box has an enclosure and an openable top portion mounted to the enclosure. The openable top has a displaceable lid. The lid is selectively moved by the activation of an electric motor under the control of a control unit. The electric motor and the control unit are mounted within the enclosure.

Figure 2:
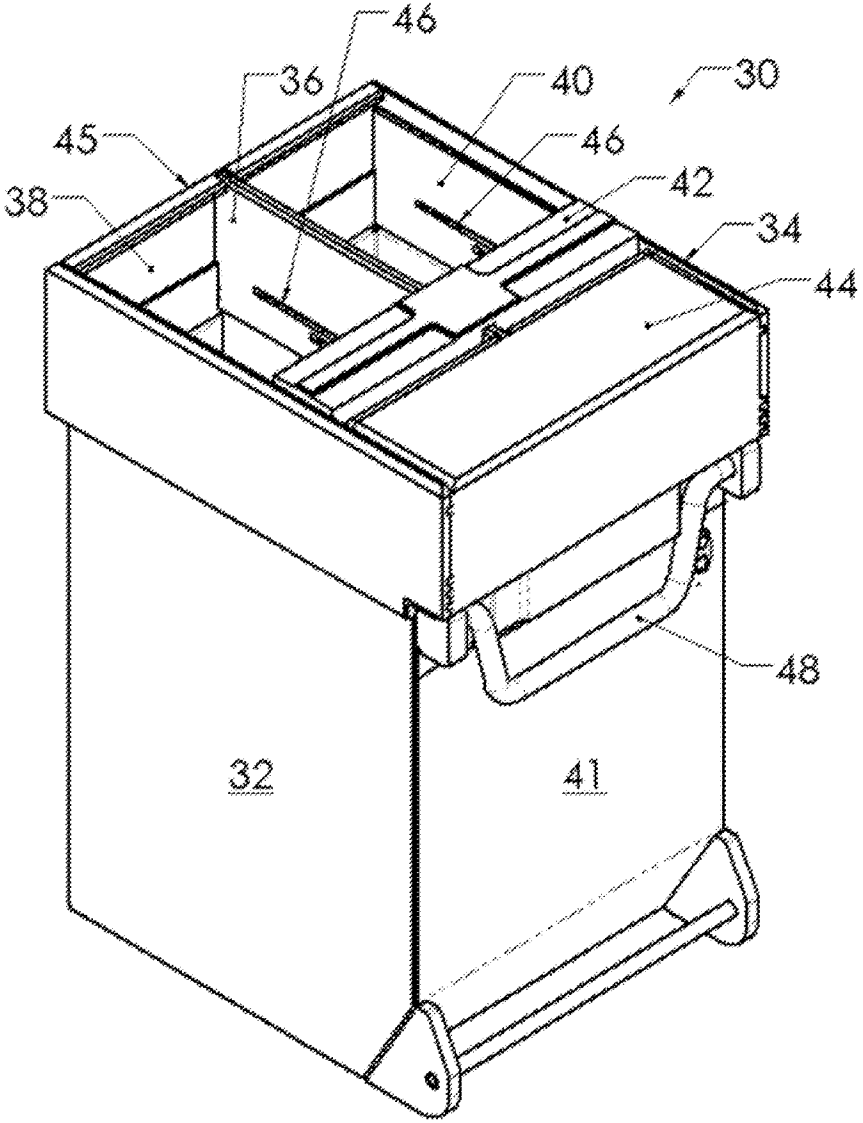
FIG. 2 (prior art) is a perspective view of a conventional cash box mounted within the payment terminal of FIG. 1.
Figure 1:
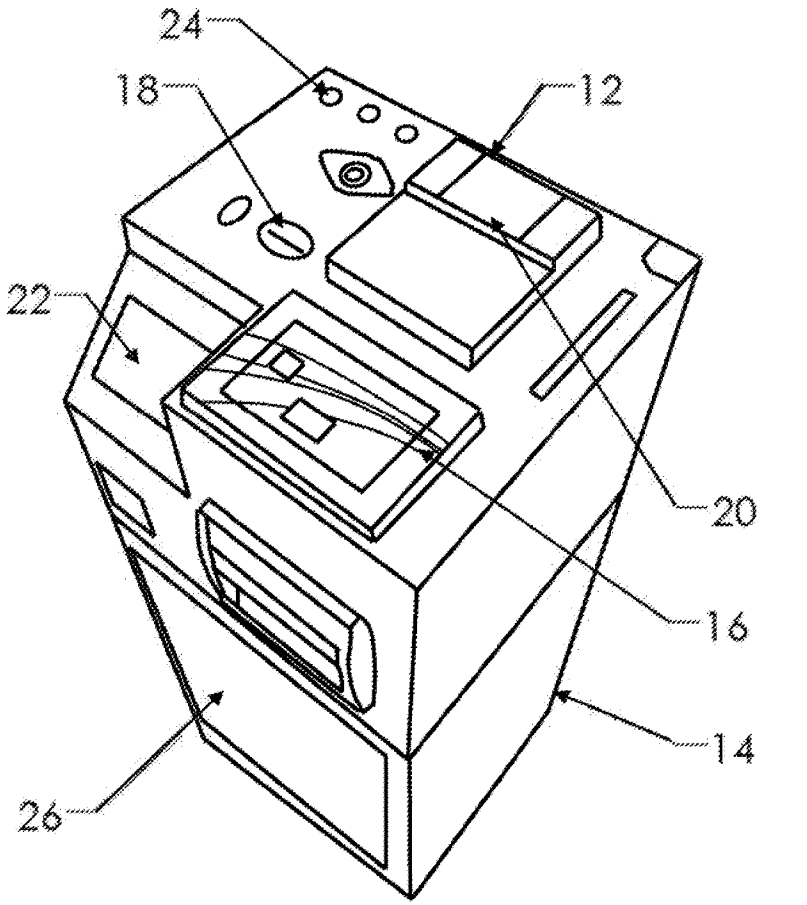
FIG. 1 (prior art) is a perspective view of a payment terminal installed in a bus or like vehicle.

In an embodiment, the enclosure of the autonomous cash box is sized and configured to be compatible with earlier cash boxes so that it may be mounted to a conventional payment terminal such the payment terminal 10 of FIG. 1, within the internal space of the pedestal 14. The enclosure is solid and is intended to prevent unauthorized access. For the same reason, the top portion is fixedly mounted to the enclosure. The top portion may be open or closed by displacing the lid when the control unit the enclosure receives a wireless opening or closing command. Use of commands transmitted via electrical signals applied on connectors mounted to the enclosure to open and close the top portion is also contemplated In the same or another embodiment, the lid is formed of a carrier and of one or more curtain plates. The control unit causes the electric motor to rotate a lead screw connected to the carrier via a flange nut. Rotation of the lead screw causes a displacement of the carrier. The one or more curtain plates follow the carrier to open or close the top portion of the autonomous cash box. Different types of lids may be contemplated. As an alternative example, a plate may be rotated or slid to selectively block or free up an opening defined on the top portion of the autonomous cash box.

Figure 3:
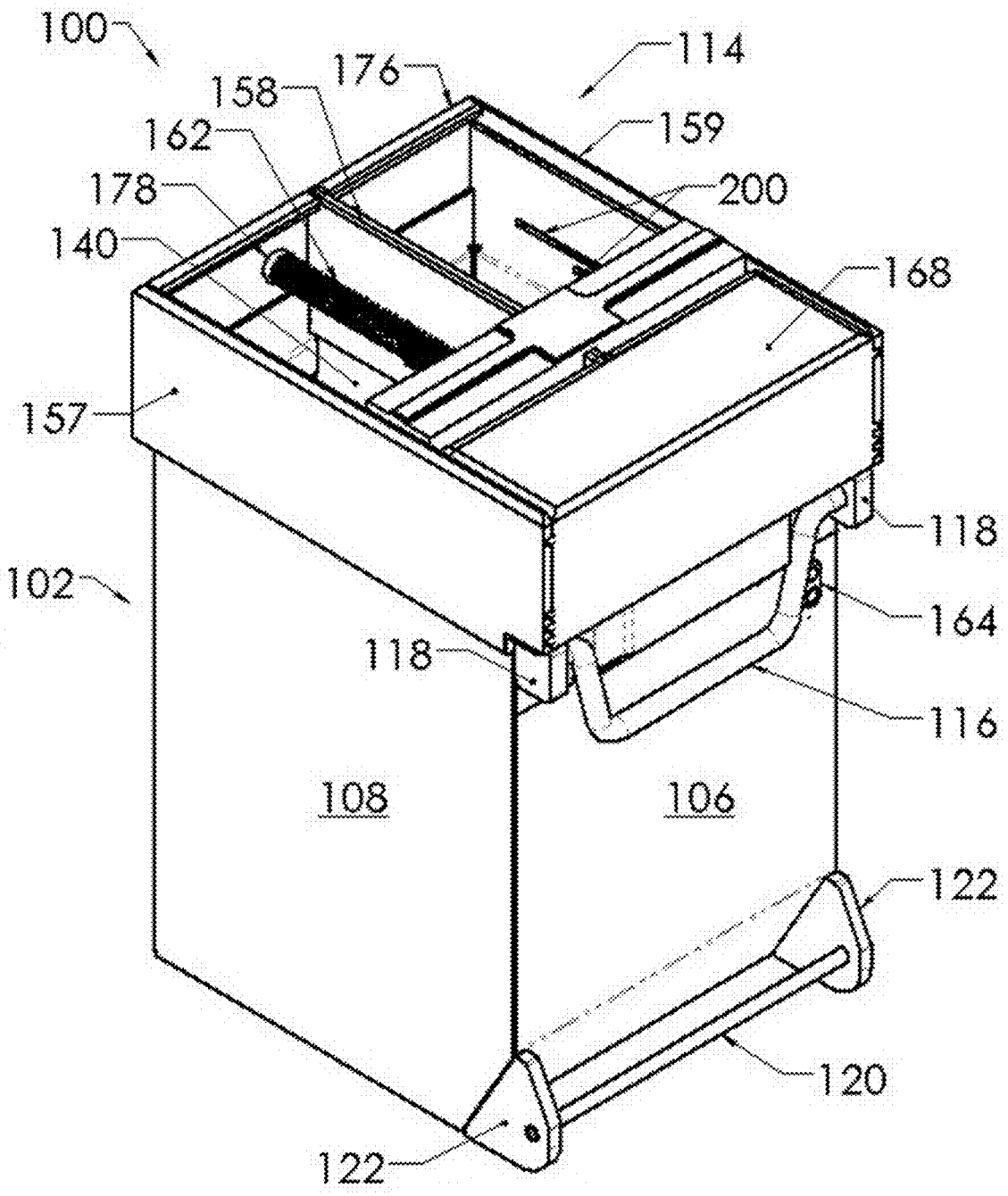
FIG. 3 is a front perspective view of an autonomous cash box according to an embodiment.
Figure 5:
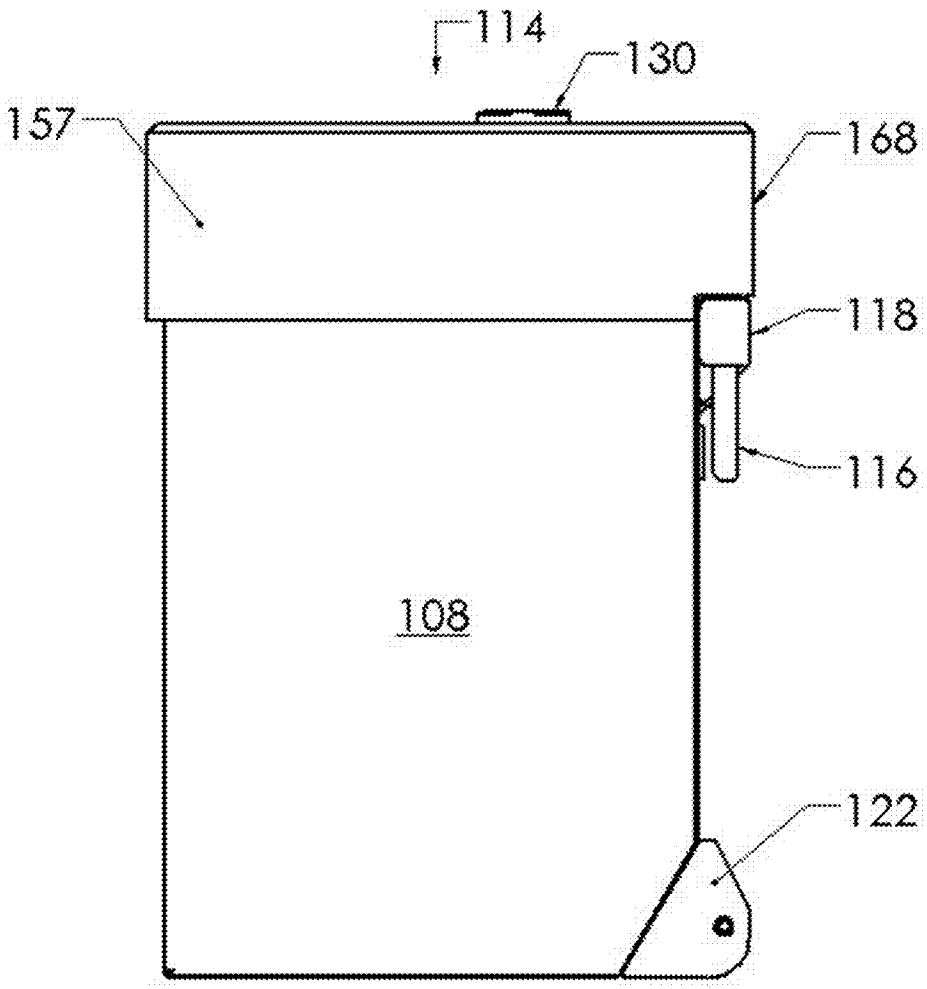
FIG. 5 is a right side elevation view of the autonomous cash box.
Figure 4:
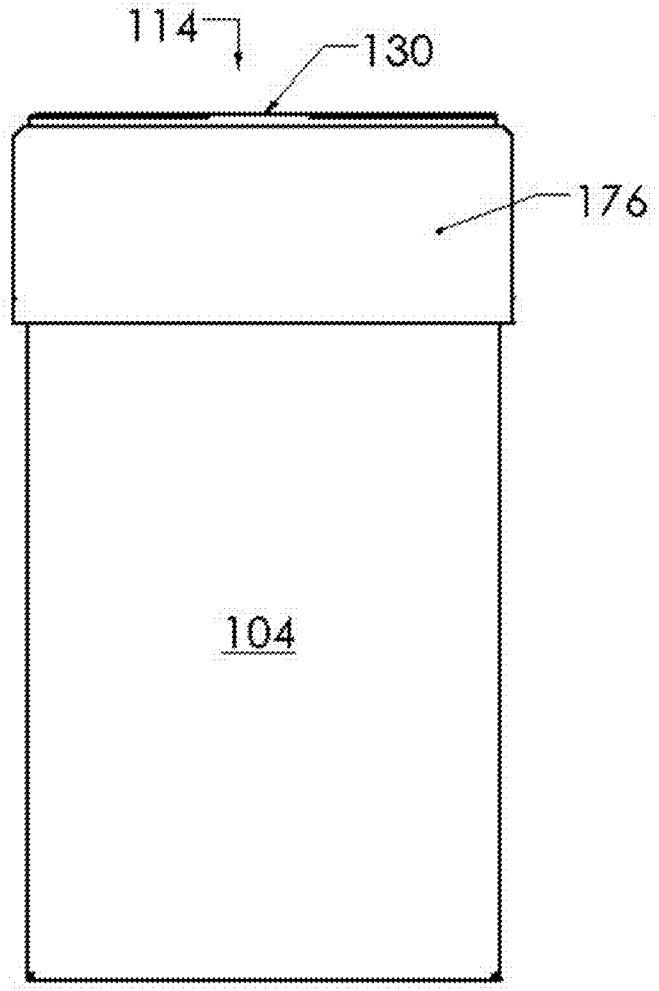
FIG. 4 is a rear elevation view of the autonomous cash box.
Figure 7:
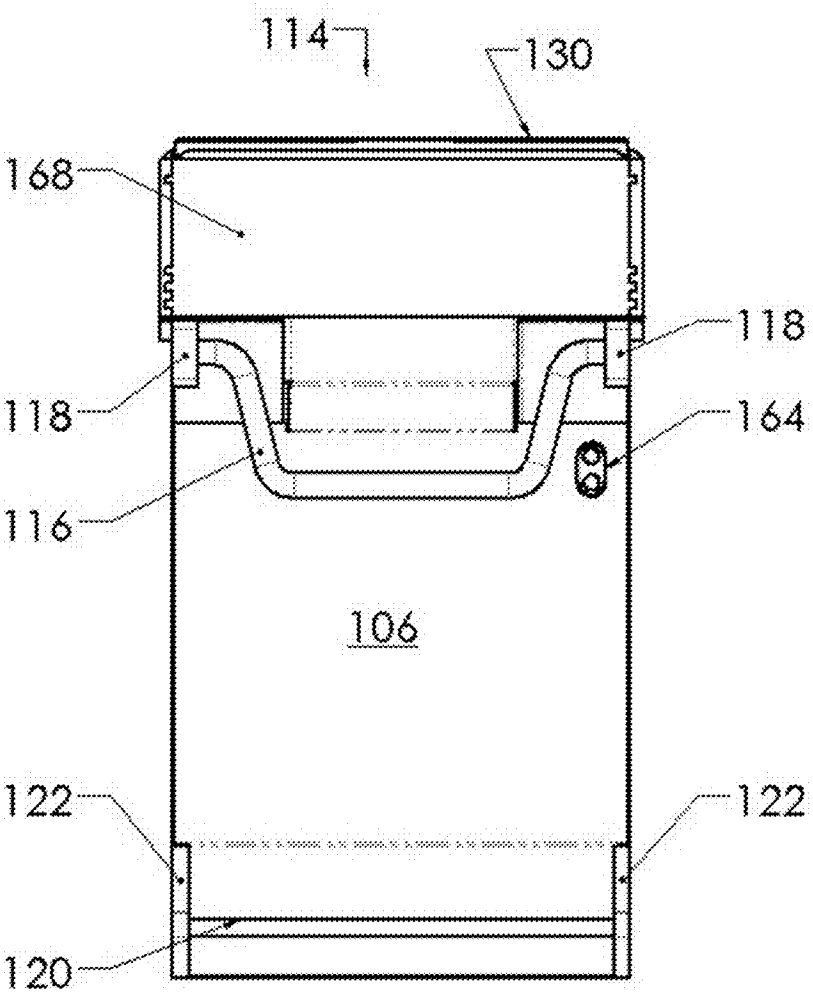
FIG. 7 is a front elevation view of the autonomous cash box.
Figure 6:
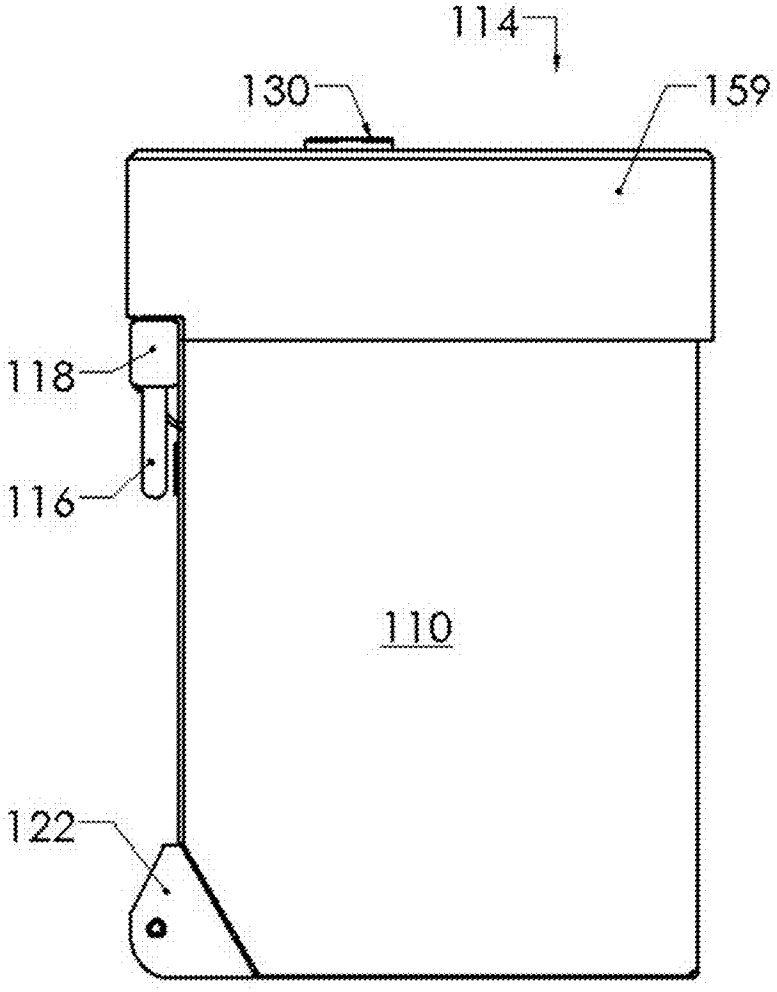
FIG. 6 is a left side elevation view of the autonomous cash box.
Figure 8:
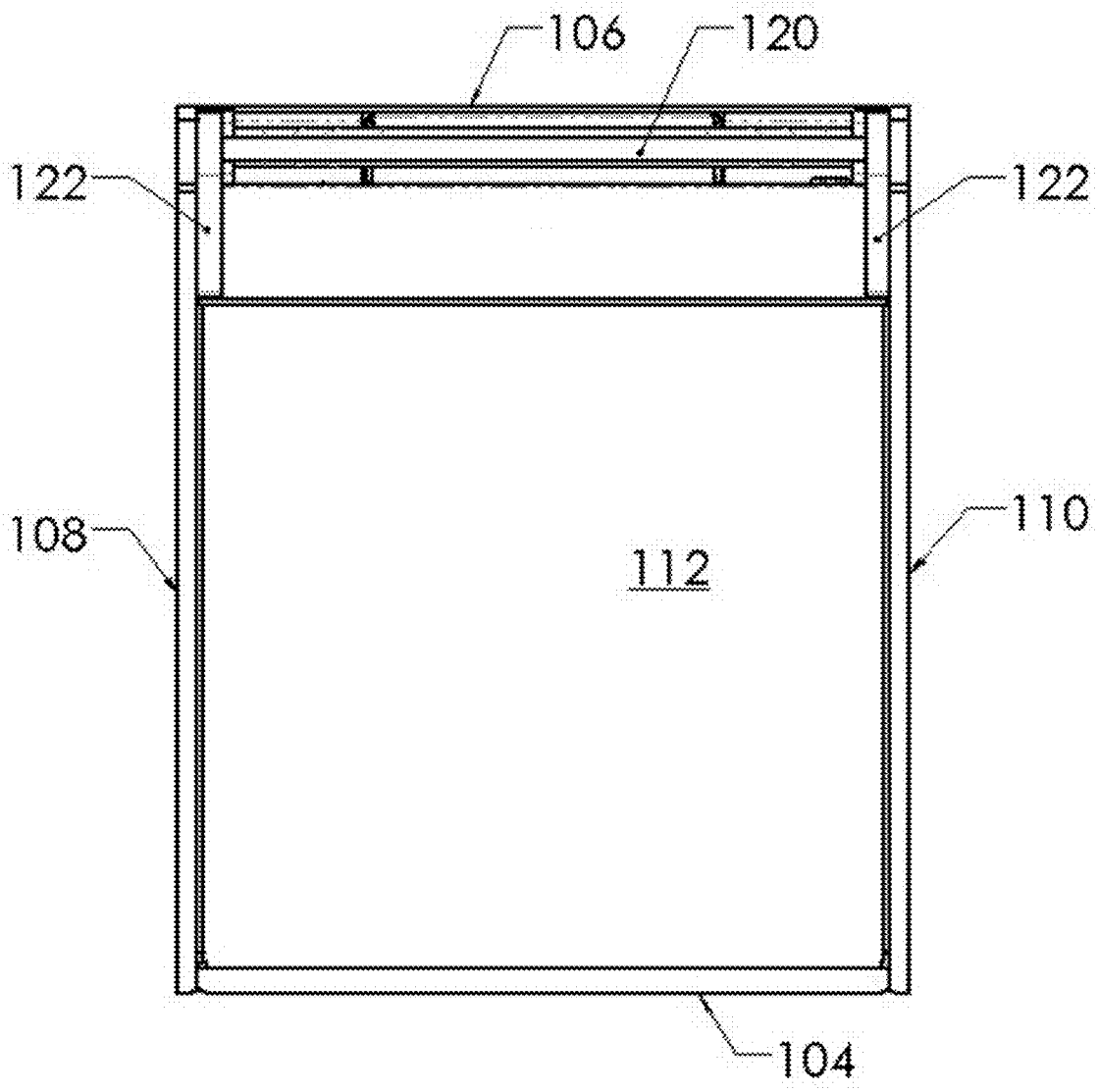
FIG. 8 is a bottom plan view of the autonomous cash box.

Referring now to the drawings, FIG. 3 is a front perspective view of an autonomous cash box according to an embodiment. FIG. 4 is a rear elevation view of the autonomous cash box. FIG. 5 is a right side elevation view of the autonomous cash box. FIG. 6 is a left side elevation view of the autonomous cash box. FIG. 7 is a front elevation view of the autonomous cash box. FIG. 8 is a bottom plan view of the autonomous cash box. As shown on FIGS. 3-8, an autonomous cash box 100 has an enclosure 102 having a fixed rear panel 104, a fixed front panel 106 forming a front face of the enclosure 102, two fixed side panels 108 and 110, and a fixed bottom panel 112. In the present description of the autonomous cash box 100, the front panel 106 is visible when opening the front door 26 of the pedestal 14 in which the autonomous cash box 100 is installed. The terms 'front' and 'rear' as applied to other elements of autonomous cash box 100 follow the same orientation.

A top portion 114 is fixedly mounted to the enclosure 102, for example and without limitation by welding the top portion 114 to the enclosure 102. The top portion 114 includes four (4) fixedly assembled components including a front upper panel 168 having a L-shaped cross-section, lateral upper panels 157 and 159, and a rear upper panel 176.

Though the assembly formed of the enclosure 102 and the top portion 114 may not be indestructible, it is constructed to be very solid and sturdy to safely contain the monies received therein from the payment interface 12 of a payment terminal 10.

As illustrated, a handle 116 may be mounted to the enclosure 102 via mounting blocks 118 affixed to both edges of the front panel 106, at its junction to the front upper panel 168. The handle 116 is intended to facilitate insertion and removal of the autonomous cash box 100 in and out of the pedestal 14 of the payment terminal 10. A straight bar 120 is mounted to straight bar ears 122 placed on bottom edges of the front panel 106.

Figure 9B:
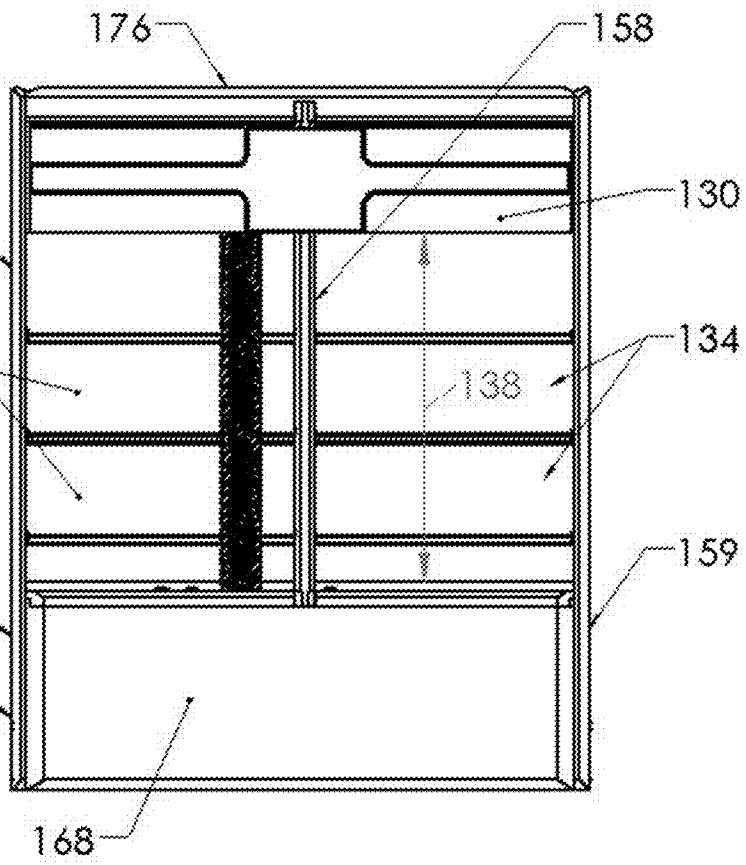
FIG. 9*b* is a top plan view of the autonomous cash box, showing the top portion in a closed top position.
Figure 9A:
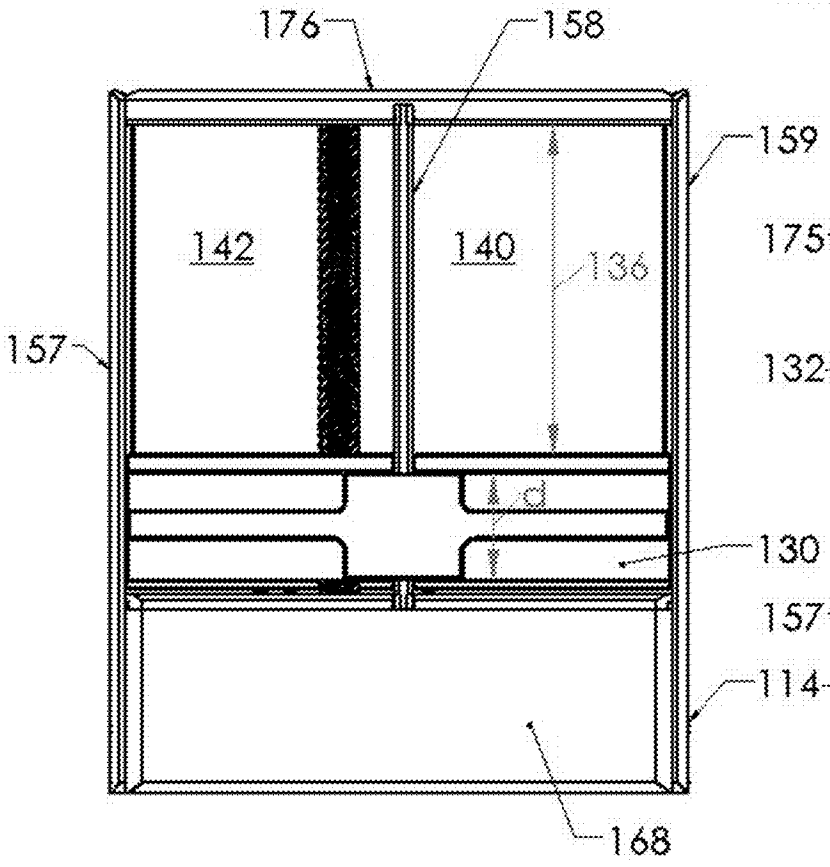
FIG. 9*a* is a top plan view of the autonomous cash box, showing a top portion in an open top position.

FIG. 9*a* is a top plan view of the autonomous cash box, showing a top portion in an open top position. FIG. 9*b* is a top plan view of the autonomous cash box, showing the top portion in a closed top position. A carrier 130 mounted to the top portion 114 is driven by an electric motor 152 (shown on later Figures) so to be displaceable between an open top position (FIG. 9*a*) and a closed top position (FIG. 9*b*). The carrier 130 is at a resting position adjacent to the front upper panel 168 on FIG. 9*a*. At least one, but generally several curtain plates 132 and 134, are also mounted to the top portion 114. The curtain plates 132 and 134 are operatively connected to the carrier 130 so that the carrier 130 entrains (i.e. draws along therewith) the curtain plates 132 and 134 as it is displaced between the open top position and the closed top positions.

As shown on FIGS. 9*a* and 9*b*, a top vertical internal separator 158 is mounted within the top portion 114. The top vertical internal separator 158 is positioned above another vertical separator 140 (shown on later Figures) located within the enclosure 102. The separators 158 and 140 are parallel to a direction of movement of the carrier to define two compartments 142 and 144 of the enclosure 102. In the presence of the separators 158 and 140, there is thus at least one curtain plate 132 and at least one curtain plate 134 configured to be displaced over each side of the separator 158 to respectively open and close the compartments 142 and 144. Without limitation, the compartment 142 may be adapted to receive coins inserted in the coin slot 18 of the payment terminal 10 and the compartment 144 may be adapted to receive bills inserted in the bill slot 20 of the payment terminal 10. A variant of the enclosure 102 without the separators 140 and 158 may be contemplated, in which case one of more curtain plates may extend over an entire width of the enclosure 102.

A longitudinal breadth 136 of an opening of the top portion 114 is shown on FIG. 9*a*. This length 136 corresponds to a total length 138 of displacement of the carrier 130 that is to be covered by the one of more curtain plates 132 and 134. The carrier 130 has a depth 'd'. In the illustrated example, each of the curtain plates 132 and 134 has a similar depth 'd' or may have a smaller depth. The number of each of the curtain plates 132 and 134 is generally determined by a ratio of the length 138 of displacement of the carrier 130 over the depth of the curtain plates 132 and 134. A single curtain plate (or a single curtain plate 132 and 134 over each of the compartments 142 and 144) could effectively suffice to close the top portion 114 in an embodiment where the length 138 of displacement of the carrier 130 would not exceed the depth the single curtain plate. For compatibility reasons, the longitudinal breadth 136 of opening of the top portion 114 may be selected so that the opening of the top portion 114 extends underneath both the coin slot 18 and the bill slot 20 of the payment box 10.

Figure 10:
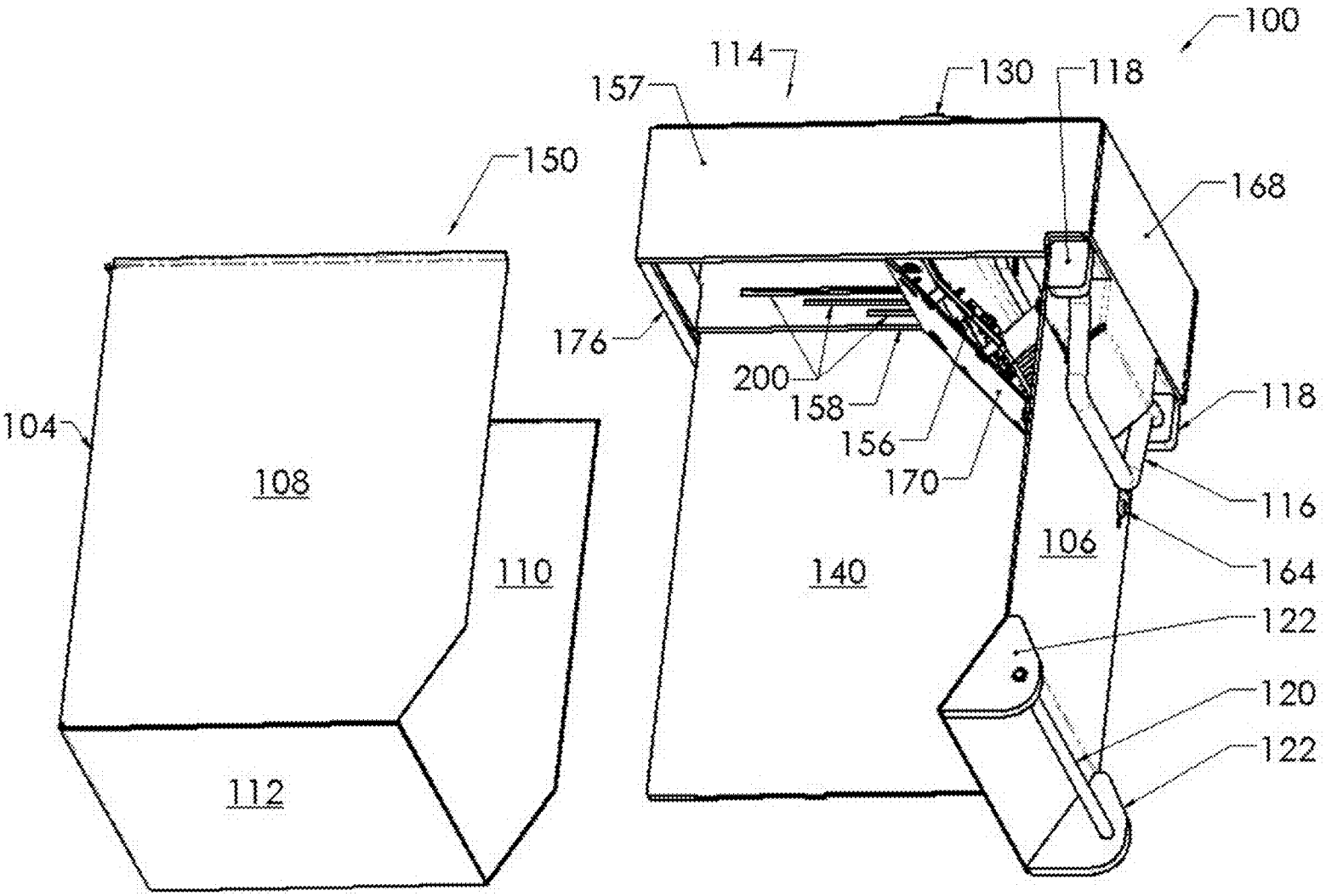
FIG. 10 is a perspective view of the autonomous cash box with a part of its enclosure detached from the autonomous cash box.
Figure 11:
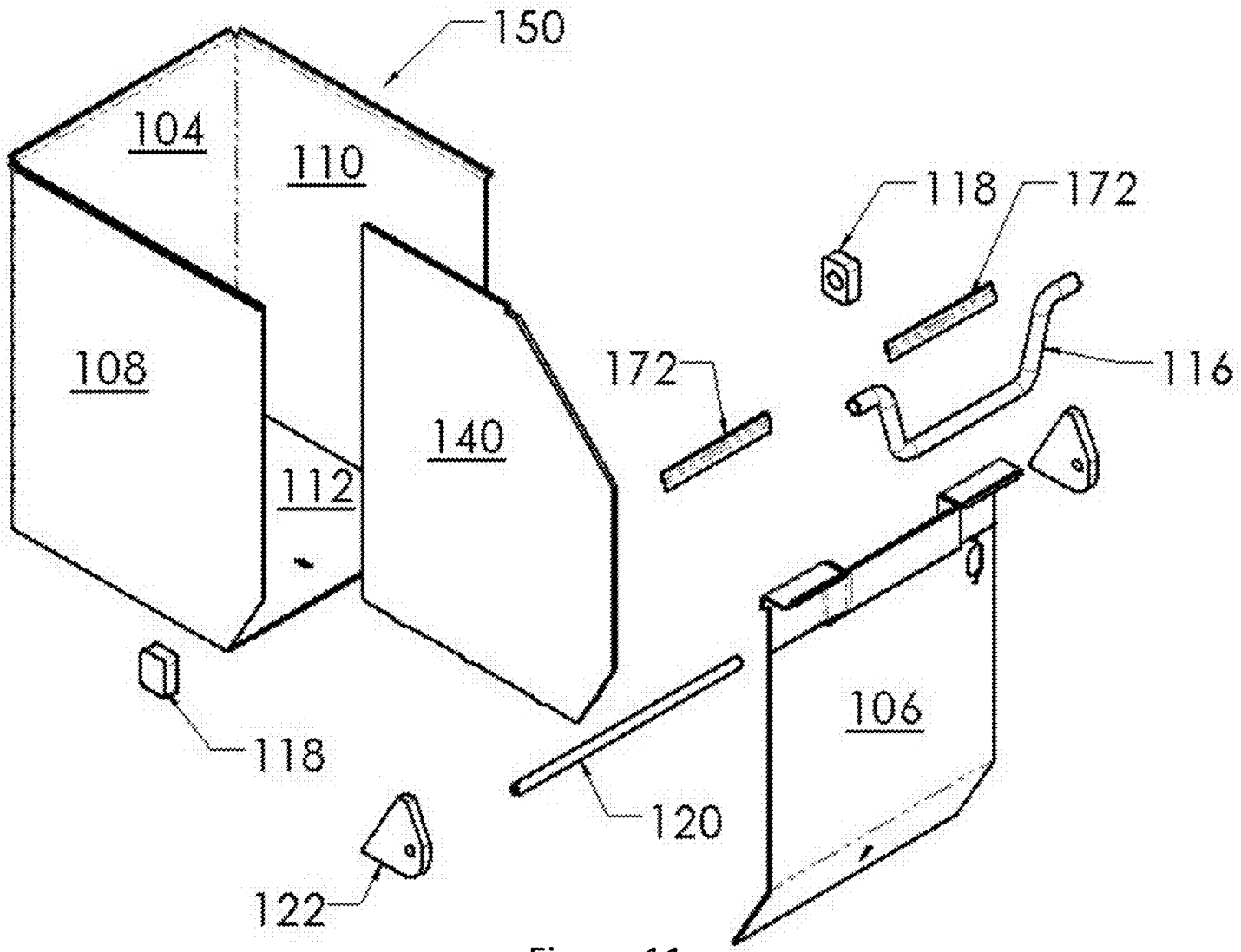
FIG. 11 is an exploded view of lower components of the autonomous cash box.
Figure 12:
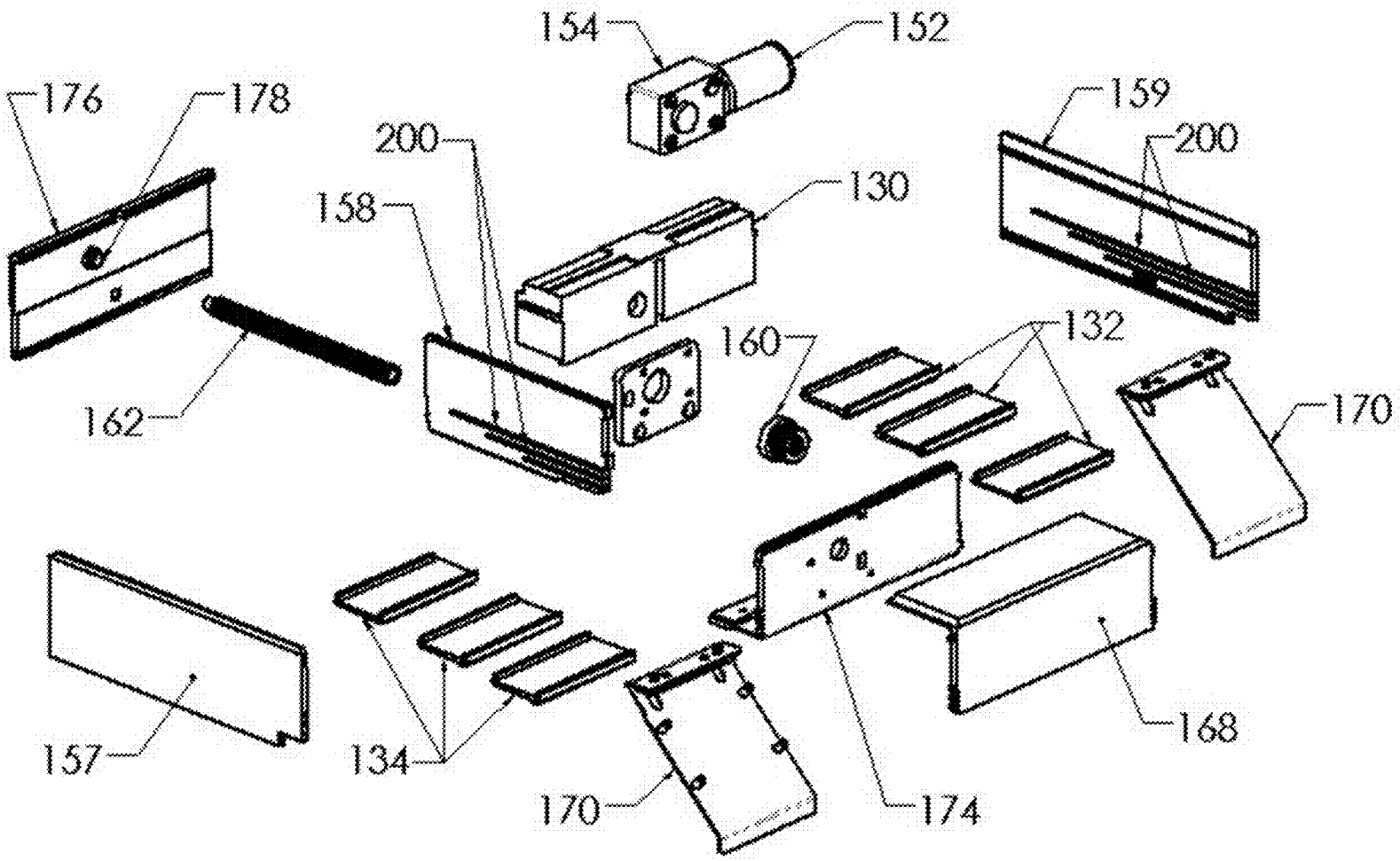
FIG. 12 is an exploded view of upper components of the autonomous cash box.
Figure 13:
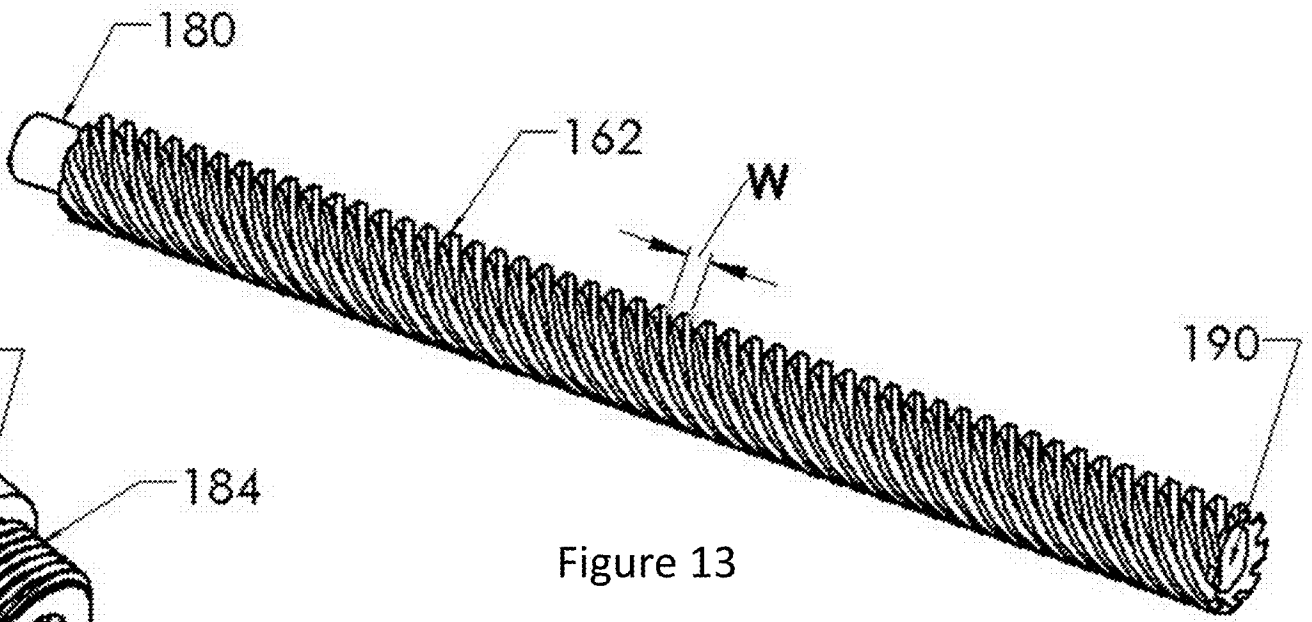
FIG. 13 is a detailed view of a lead screw of the autonomous cash box.
Figure 14:
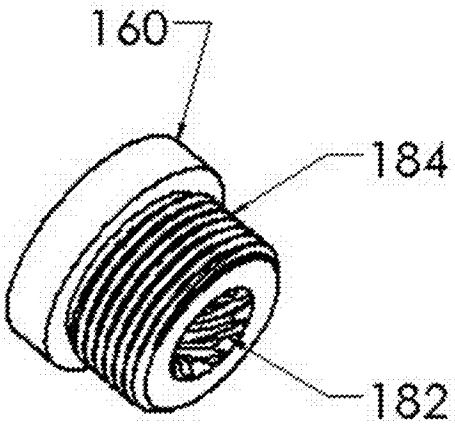
FIG. 14 is a detailed view of a flange nut of the autonomous cash box.
Figure 15:
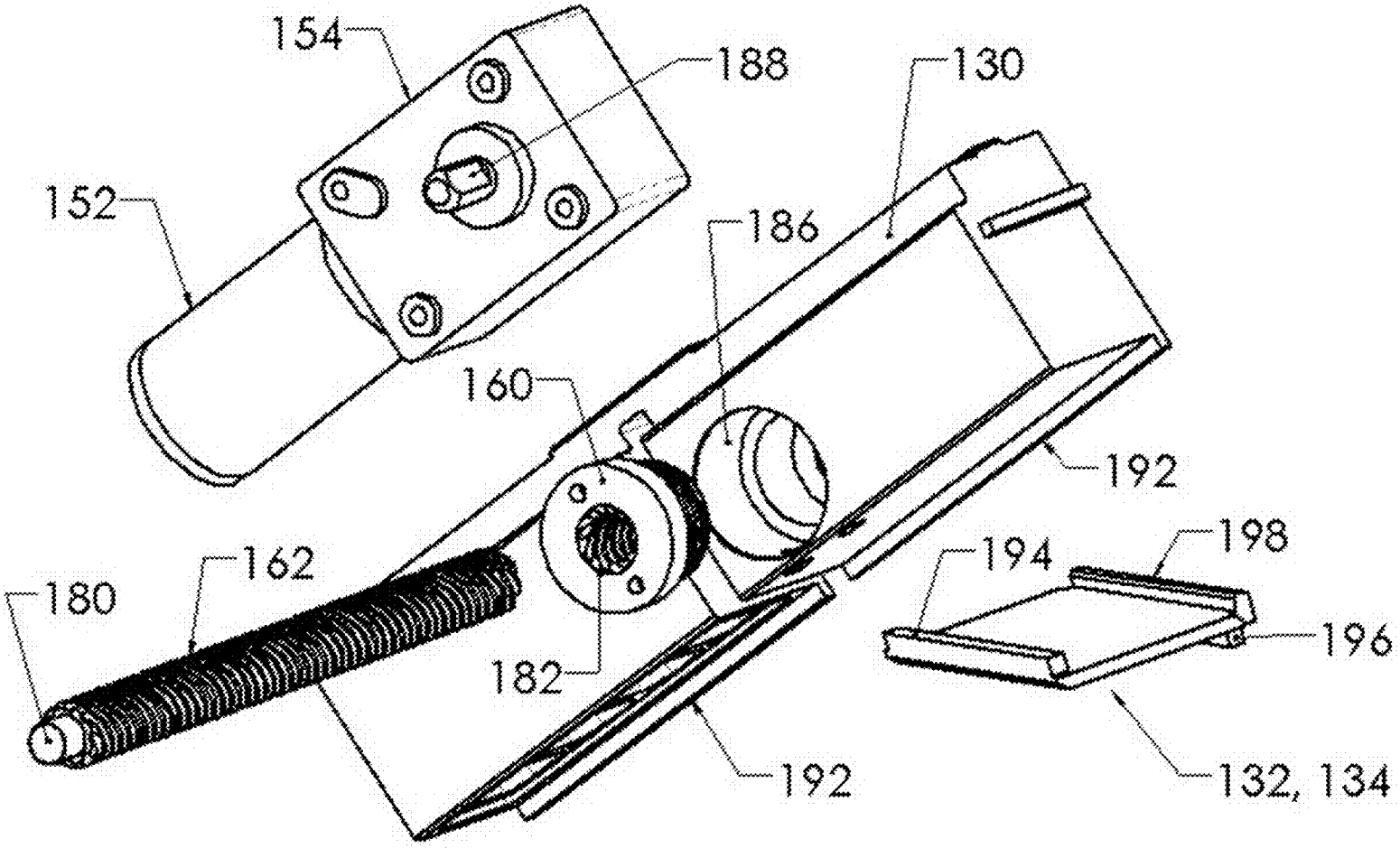
FIG. 15 is an exploded view showing components of a mechanism for closing the autonomous cash box.
Figure 16:
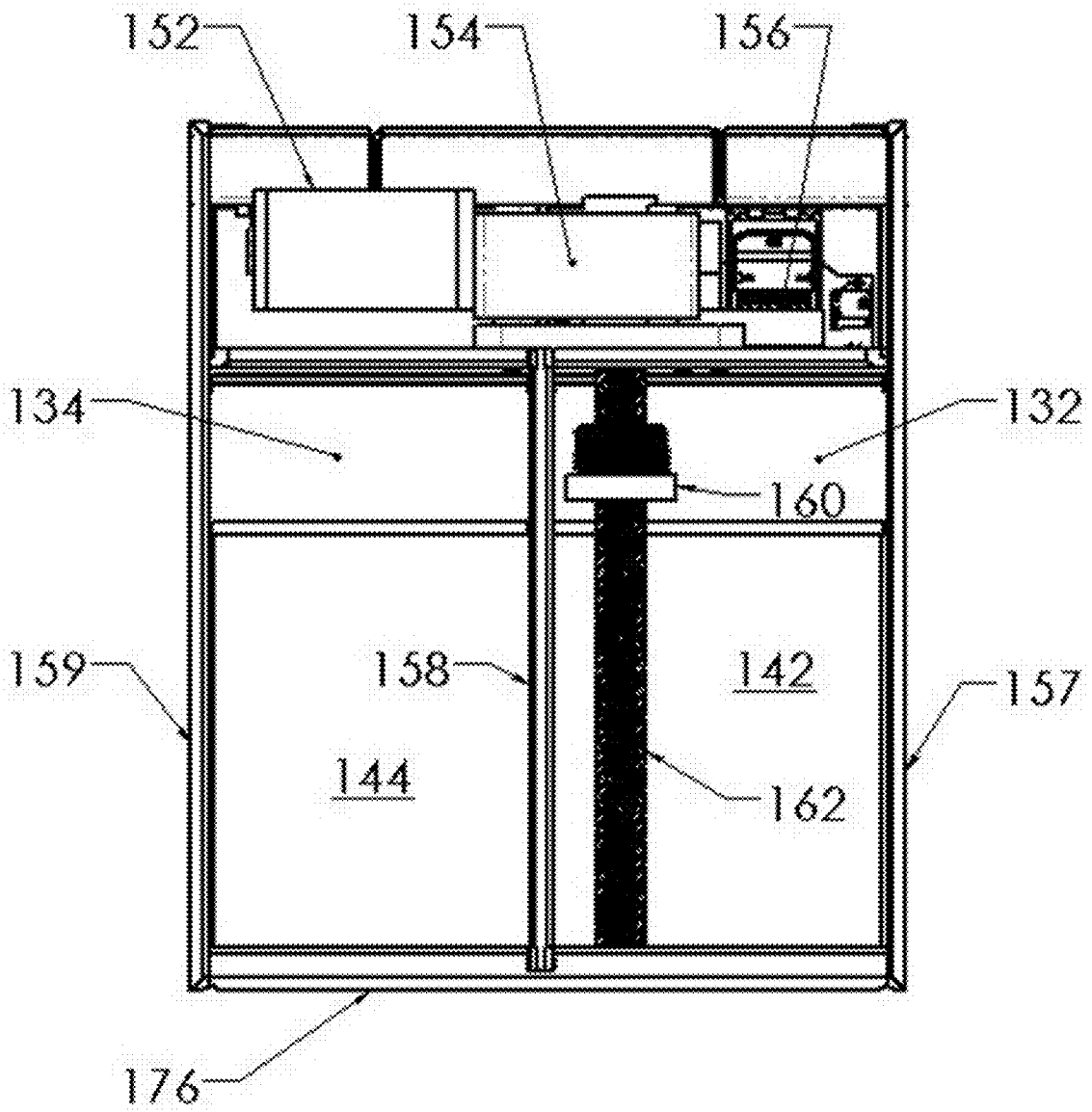
FIG. 16 is a top plan view of the autonomous cash box, with some components removed.
Figure 17:
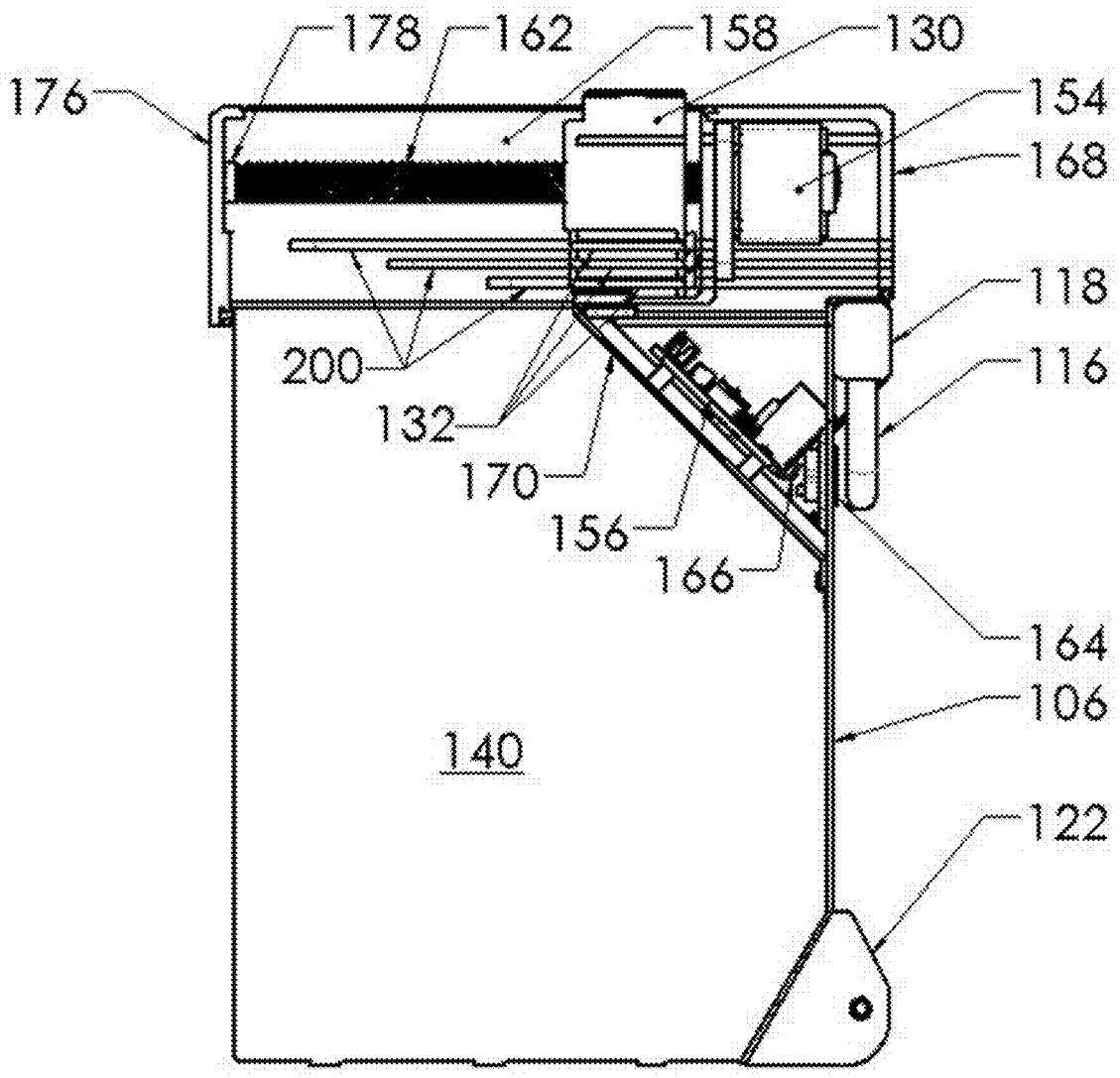
FIG. 17 is a right side elevation view of the autonomous cash box with a part of its enclosure removed.
Figure 18:
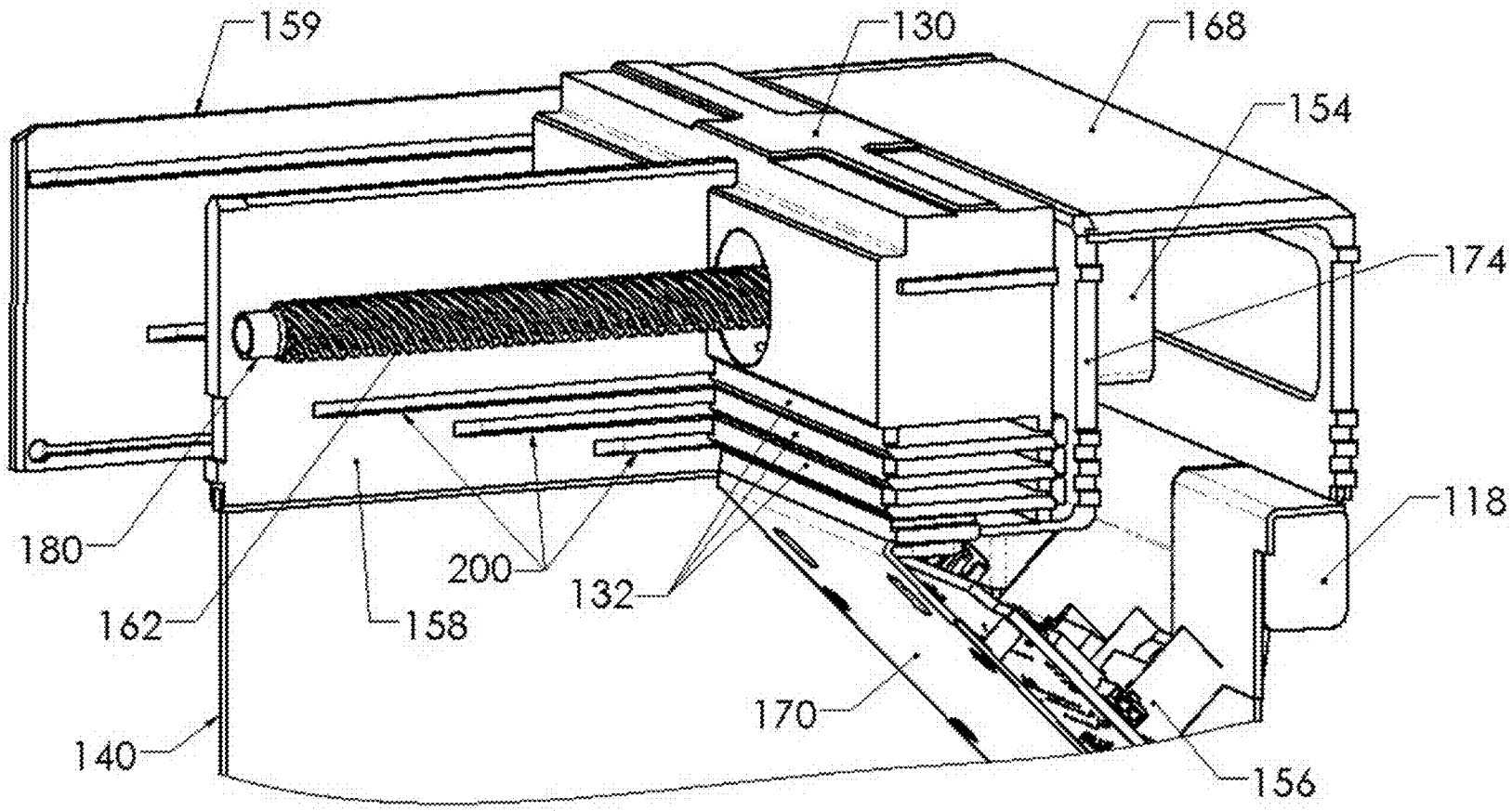
FIG. 18 is a perspective detailed view taken from a right side of a motion mechanism of the autonomous cash box.
Figure 19:
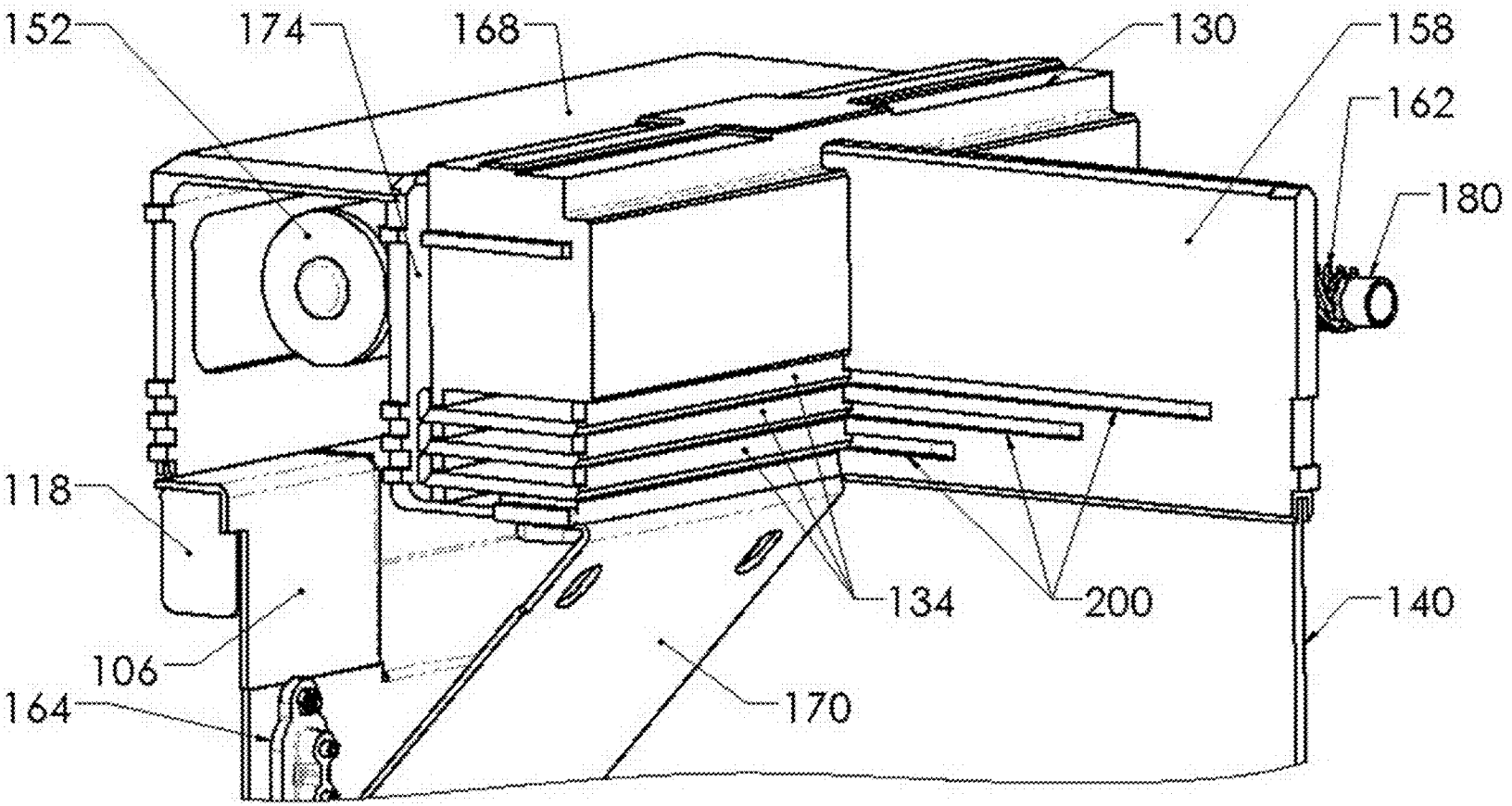
FIG. 19 is another perspective detailed view taken from a left side of the motion mechanism of the autonomous cash box.

FIG. 10 is a perspective view of the autonomous cash box with a part of its enclosure detached from the autonomous cash box. FIG. 11 is an exploded view of lower components of the autonomous cash box. FIG. 12 is an exploded view of upper components of the autonomous cash box. FIG. 13 is a detailed view of a lead screw of the autonomous cash box. FIG. 14 is a detailed view of a flange nut of the autonomous cash box. FIG. 15 is an exploded view showing components of a mechanism for closing the autonomous cash box. It should be noted that proper scale and orientation are not maintained between the components shown on FIG. 15. FIG. 16 is a top plan view of the autonomous cash box, with some components removed. FIG. 17 is a right side elevation view of the autonomous cash box with a part of its enclosure removed. FIG. 18 is a perspective detailed view taken from a left side of a motion mechanism of the autonomous cash box. FIG. 19 is another perspective detailed view taken from a right side of the motion mechanism of the autonomous cash box. Various constructional details of the autonomous cash box 100 are shown on the various FIGS. 10-19.

In more details, FIGS. 10 and 11 show that the rear panel 104, the side panels 108, 110 and the bottom panel 112 may be constructed as a single unit 150. The single unit 150 may for example be welded to the front panel 106 when the enclosure 102 is assembled so that each of the front, rear, bottom and side panels of the enclosure 102 are in a fixed relation to one another. The vertical separator 140 is positioned underneath the top vertical separator 158. Combining the separators 140 and 158 as a single panel is also contemplated.

Components of the autonomous cash box 100 mounted within the enclosure 102 and/or within the top portion 114 include an electric motor 152 having an integral gearbox unit 154, a control unit 156, a flange nut 160, a lead screw 162, an electrical connector 164 mounted on one of the panels of the enclosure 102, for example on the front panel 106, an internal electrical connection such as for example a wire 166 allowing the control unit 156 to receive electrical power from the electrical connector 164, angled panels 170, plates 172 mounted to an inside face of the front panel 106 for receiving lower ends of the angled panels 170, and a bracket 174 for supporting the electric motor 152 and its gearbox unit 154. The control unit 156 is mounted on one of the angled panels 170. The motor 152 is mounted above one of the angled panels 170. The angled panels 170 isolate the compartments 142 and 144 from the motor 152, the gearbox unit 154, the control unit 156 and the electrical connector 164. Each angled panel 170 extends at its lower end to an inside face of the front panel 106 of the enclosure 106, underneath the front upper panel 168. Each angled panel 170 extends at its upper end under the resting position of the carrier 130 and of the curtain plates 132 or 134, which is the position of the carrier 130 and of the curtain plates 132 and 134 when in the open top position. Otherwise stated, the angled panels 170 are away from a downward path of bills and coins falling into the compartments 142 and 144.

Other components of the autonomous cash box 100 include various other plates, screws, nuts and bolts.

The control unit 156 is operatively connected to the electric motor 152. The control unit 156 is configured to receive a wireless command to open the autonomous cash box 100 and, in response to the wireless command to open the autonomous cash box 100, cause the electric motor 152 to displace the carrier 130 toward the open top position illustrated on FIG. 9*a*. The control unit 156 is also configured to receive a wireless command to close the autonomous cash box 100 and, in response to the wireless command to close the autonomous cash box 100, cause the electric motor 152 to displace the carrier toward the closed top position illustrated on FIG. 9*b*.

In an embodiment, the autonomous cash box 100 is coupled to the carrier 130 via the flange nut 160 and the lead screw 162. The flange nut has internal threads 182 adapted for mating with threads of the lead screw 162. The flange 160 has external threads 184 useable to mount the flange 160 to an internal opening 186 of the carrier 130. When assembled, an output 188 of the gearbox unit 154 is inserted in an opening 190 at a front-end of the lead screw 162. The rear upper panel 176 has an end 178 for receiving a rear-end 180 of the lead screw 162. The lead screw 162 is inserted within the flange 160 that, in turn, is mounted to the carrier 130. Actuation of the gearbox unit 154 by the electric motor 152 causes a rotation of the lead screw 162, in turn causing a longitudinal displacement of the carrier 130. In an embodiment, the lead screw 162 is a multi-start thread screw having a plurality of intertwined threads running parallel to one another. Rotation of the multi-start thread screw allows the flange nut 160 to advance along a length of the lead screw 162 by a multiple of a thread width 'w' of the lead screw 162 at each rotation of the lead screw 162. Although rotating the lead screw 162 allows to easily move the flange nut 160 and the carrier 130 between the open and closed position of the top portion 114, the reverse is not true: applying a longitudinal force on the carrier 130 is not expected to cause a rotation of the lead screw 162.

When the carrier 130 moves toward the closed position of the autonomous cash box 100, its lower lips 192 push on rear upper lips 194 of first curtain plates 132, 134 that are mounted immediately underneath the carrier 130. In turn, once the first curtain plates 132, 134 have sufficiently moved, their lower lips 196 push on rear upper lips 194 of second curtain plates 132, 134 that are mounted in a next lower position. This sequence continues until the carrier 130 reaches its closed position, the entire longitudinal breadth 136 of the opening of the top portion 114 being now closed by the curtain plates 132, 134. When the carrier 130 moves back toward the open position, its lower lips 192 push on front upper lips 198 of the first curtain plates 132, 134 that are mounted immediately underneath the carrier 130. In turn, once the first curtain plates 132, 134 have sufficiently moved, their lower lips 196 push on front upper lips 198 of second curtain plates 132, 134 that are mounted in a next lower position. This sequence continues until the carrier 130 reaches its resting position against the front upper panel 168. Hence, a displacement of first ones of the curtain plates 132 and 134 causes a displacement of adjacent ones of the curtain plates 132 and 134 until the carrier 130 and the plurality of curtain plates 132 and 134 are positioned to fully open or to fully close the top portion of the autonomous cash box 100. As shown for example on FIGS. 18-20, the curtain plates 132 and 134 are stacked directly underneath the carrier 130 is in the resting position. Other configurations may be contemplated, provided that an opening breadth of the top portion 114 sufficient to allow coins and bills to fall from the coin slot 18 and the bill slot 20 is obtained when the carrier 130 is at the resting position.

It may be observed that the lead screw 162 extends over the compartment 142 that would receive coins if used within the payment terminal 10 of FIG. 1, owing to the respective positions of the coin slot 18, of the compartment 142 and of the lead screw 162. Coins falling into the compartment 142 may collide with the lead screw 162 without causing any damage or malfunction. While an opposite configuration placing the lead screw 162 above the compartment 144 may be contemplated, risks of jamming of bills over the lead screw 162 are prevented by positioning of the lead screw 162 over the compartment 142.

Track guides 200 are formed on inside faces of the lateral upper panels 157 and 159 and on two opposite faces of the top vertical separator 158. The curtain panels 132 and 134 are guided by the track guides 200 as they are displaced between the open and closed top positions.

Figure 20:
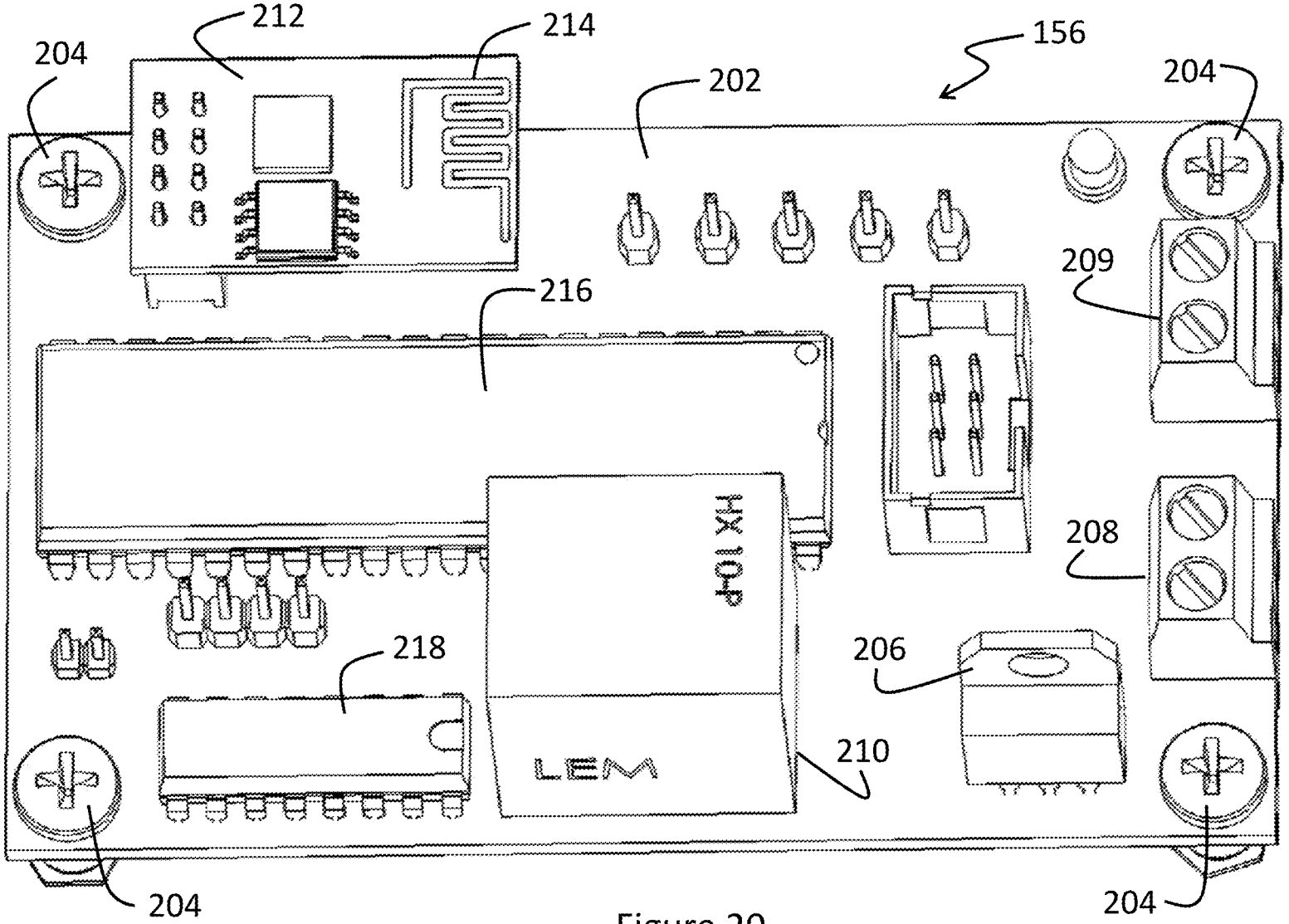
FIG. 20 is a detailed view of a control unit of the autonomous cash box.

FIG. 20 is a detailed view of a control unit of the autonomous cash box. The control unit 156 is mounted on one of the angled panels 170 that are, in turn, mounted in the enclosure 102. The control unit 156 comprises a printed circuit board (PCB) 202 and a plurality of screws 204 for mounting the PCB 202 to the angled panel 170. The wire 166 connected at one end to the electrical connector 164 mounted on the front panel 106 of the enclosure 102 is attached at an opposite end to a connector 206 to provide power to the control unit 156 and to selectively provide power to the motor 152. The enclosure 102 forms a ground connection for the control unit 156 and for the electric motor 152 via the screws 204. Current flows from the connector 206 to the motor 152 via switchable PCB-mounted connectors 208 and 209.

The control unit 156 comprises a sensor 210 of an electric current flowing through the electric motor 152. The sensor 210 may for example be an HX 10-P Hall-type current sensor from LEM™ of Geneva, Switzerland.

A wireless receiver 212 having an antenna 214 is mounted on the PCB 202 control unit 156. The wireless receiver 212 is adapted to receive wireless commands to open and close the autonomous cash box 100. The wireless receiver 212 may be, for example, a wireless fidelity (WiFi) receiver or a Bluetooth™ receiver.

A processor 216 (or a plurality of cooperating processors) is operatively connected to the connector 206, to the switchable connectors 208 and 209, to the sensor 210, to the wireless receiver 212 and to a memory device 218 (or a plurality of cooperating memory devices). A large variety of commercially available processors may be used on the control unit 156. The processor 216 executes functions allowing treating commands received at the wireless receiver 212. In particular, when the wireless receiver 212 receives a wireless command to open the autonomous cash box 100, the processor 216 causes the electric motor 152 to displace the carrier 130 toward the open top position illustrated on FIG. 9*a*. To this end, the processor 216 establishes a connection between the connector 206 and the switchable connector 208 so that current flows toward the electric motor 152 according to a first polarity. When the wireless receiver 212 receives a wireless command to close the autonomous cash box 100, the processor 216 causes the electric motor 152 to displace the carrier 130 toward the open closed position illustrated on FIG. 9*b*. To this end, the processor 216 establishes a connection between the connector 206 and the switchable connector 209 so that current flows toward the electric motor 152 according to a second polarity, which is inverse from the first polarity.

For security purposes, the processor 216 implements an authentication protocol used to authenticate the wireless commands requesting to open and close the autonomous cash box 100 before causing the electric motor 152 to displace the carrier 130 toward the open and closed positions. The processor 216 may obtain parameters of the authentication protocol that are stored on the memory device 218.

The electric motor 152 stops rotating when the carrier 130 abuts against one of the front upper panel 168 or the rear upper panel 176. At that time, the electric motor 152 starts drawing more current than while rotating normally. The processor 216 receives an electric current measurement from the sensor 210. When detecting that the electric current meets or exceeds a predetermined threshold stored in the memory device 218, the processor 216 causes an opening of the switchable connector 208 or 209 to interrupt delivery of the electric current to the electric motor 152. The processor 216 therefore acts upon the electric current measurement to control stopping the motion of the carrier 130 and of the curtain plates 132 and 134. The control unit 156 does not rely on limit switches or similar devices for determining when the autonomous cash box 100 is fully opened or fully closed.

Figure 21:
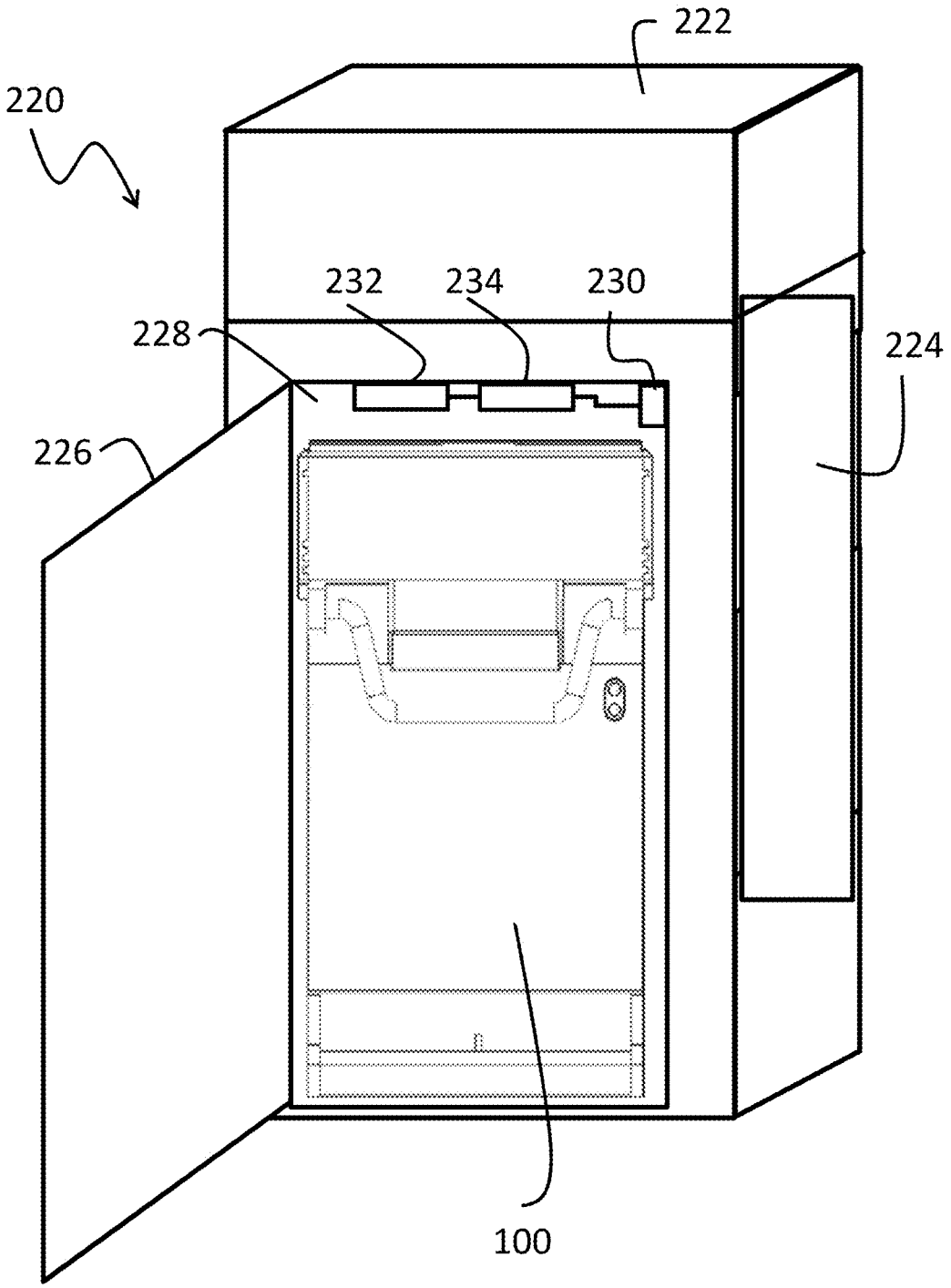
FIG. 21 is a schematic diagram illustrating a payment terminal adapted to receive the autonomous cash box.

FIG. 21 is a schematic diagram illustrating a payment terminal adapted to receive the autonomous cash box. A payment terminal 220 includes a payment interface 222 mounted on top of a pedestal 224. In an embodiment, the payment interface 222 may be similar or equivalent to the payment interface 12 of FIG. 1. The pedestal has a front door 226 shown in an open position. An internal space 228 of the pedestal 224 is sized and configured for receiving the autonomous cash box 100. In particular, the payment interface 222 and the internal space 228 of the pedestal 224 are sized and configured so that a cash payment received at the payment interface 222 falls into the open top portion 114 of the autonomous cash box 110 when received in the pedestal 224.

The payment terminal 200 also comprises a door position detector 230, a wireless transmitter 232, and a controller 234. The controller 234 is operatively connected to the door position detector 230 and to the wireless transmitter 232. The controller 234 is configured to cause the wireless transmitter 232 to transmit the wireless command to close the autonomous cash box 100 when the door position detector 230 detects an opening of the front door 226 and to transmit the wireless command to open the autonomous cash box when the door position detector 230 detects a closing of the front door 226.

Those of ordinary skill in the art will realize that the description of the autonomous cash box and payment terminal are illustrative only and are not intended to be in any way limiting. Other embodiments will readily suggest themselves to such persons with ordinary skill in the art having the benefit of the present disclosure. Furthermore, the disclosed autonomous cash box and payment terminal may be customized to offer valuable solutions to existing needs and problems related to securely receiving, storing and transporting coins and bills. In the interest of clarity, not all of the routine features of the implementations of the autonomous cash box and payment terminal are shown and described. In particular, combinations of features are not limited to those presented in the foregoing description as combinations of elements listed in the appended claims form an integral part of the present disclosure. It will, of course, be appreciated that in the development of any such actual implementation of the autonomous cash box and payment terminal, numerous implementation-specific decisions may need to be made in order to achieve the developer's specific goals, such as compliance with application-related, system-related, and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of cash boxes and similar structures for receiving, storing and transporting coins and bills having the benefit of the present disclosure.

The present disclosure has been described in the foregoing specification by means of non-restrictive illustrative embodiments provided as examples. These illustrative embodiments may be modified at will. The scope of the claims should not be limited by the embodiments set forth in the examples, but should be given the broadest interpretation consistent with the description as a whole.

What is claimed is:

1. An autonomous cash box for use in a payment terminal, comprising:

an enclosure;

a top portion mounted to the enclosure, the top portion having a displaceable lid;

an electric motor mounted within the enclosure; and a control unit mounted within the enclosure and operatively connected to the electric motor, the control unit being configured to activate the electric motor to selectively displace the lid to open or close the top portion of the autonomous cash box.

2. The autonomous cash box of claim 1, wherein:

the enclosure has a fixed front panel, a fixed rear panel, two fixed side panels, and a fixed bottom panel; and the top portion is fixedly mounted to the enclosure.

3. The autonomous cash box of claim 1, wherein the lid comprises:

a carrier driven by the electric motor, the carrier being displaceable between an open top position and a closed top position; and at least one curtain plate operatively connected to the carrier, the at least one curtain plate being configured to be entrained by the carrier between the open top position and the closed top position.

4. The autonomous cash box of claim 3, wherein the top portion comprises lateral upper panels, track guides being formed on inside faces of the lateral upper panels, the track guides being configured to guide a displacement of the at least one curtain plate.

5. The autonomous cash box of claim 3, further comprising a vertical internal separator mounted within the enclosure, the separator being parallel to a direction of movement of the carrier to define two compartments of the enclosure, wherein the at least one curtain plate comprises at least one curtain plate displaceable over each side of the separator.

6. The autonomous cash box of claim 3, further comprising:

a flange nut mounted to the carrier; and a lead screw inserted within the flange nut and driven by the electric motor so that activation of the electric motor causes a rotation of the lead screw, causing the flange nut to displace the carrier.

7. The autonomous cash box of claim 6, wherein the lead screw is a multi-start thread screw.

8. The autonomous cash box of claim 6, wherein the at least one curtain plate extends underneath the lead screw when in the closed top position.

9. The autonomous cash box of claim 3, wherein the at least one curtain plate comprises a plurality of curtain plates, a displacement of the driver causing a displacement of a first one of the curtain plates, a displacement of the first one of the curtain plates causing a displacement of an adjacent one of the curtain plates until the carrier and the plurality of curtain plates are positioned to fully open or to fully close the top portion of the autonomous cash box.

10. The autonomous cash box of claim 3, wherein the at least one curtain plate is configured to be positioned under the carrier when in the open top position.

11. The autonomous cash box of claim 10, further comprising:

a front upper panel of the top portion, the carrier being adjacent to the front upper panel when in the open top position; and an angled panel mounted in the enclosure, the angled panel extending at its lower end to an inside front face of the enclosure underneath the front upper panel, the angled panel extending at its upper end under a position of the carrier and of the at least one curtain plate when the carrier and the at least one curtain plate are in the open top position;

wherein the control unit is mounted on the angled panel and wherein the electric motor is positioned above the angled panel.

12. The autonomous cash box of claim 1, further comprising a sensor of an electric current flowing through the electric motor, wherein the control unit is further configured to receive an electric current measurement from the sensor and to interrupt delivery of the electric current to the electric motor when the electric current meets or exceeds a predetermined threshold.

13. The autonomous cash box of claim 1, further comprising:

an electrical connector mounted to one of the front panel, the rear panel, the side panels and the bottom panel; and an internal electrical connection between the control unit and the electrical connector.

14. The autonomous cash box of claim 13, wherein the enclosure forms a ground connection for the control unit and for the electric motor.

15. The autonomous cash box of claim 1, wherein the control unit is further configured to:

receive a wireless command to open the autonomous cash box;

in response to the wireless command to open the autonomous cash box, activate the electric motor to displace the lid to open the top portion of the autonomous cash box;

receive a wireless command to close the autonomous cash box; and in response to the wireless command to close the autonomous cash box, activate the electric motor to displace the to close the top portion of the autonomous cash box.

16. The autonomous cash box of claim 15, further comprising a wireless fidelity (WiFi) receiver mounted on the control unit and adapted to receive the wireless commands to open and close the autonomous cash box.

17. The autonomous cash box of claim 15, wherein the control unit implements an authentication protocol, the control unit being further configured to authenticate the commands to open and close the autonomous cash box before activating the electric motor.

18. A payment terminal comprising:

a pedestal having a door giving access to an internal space of the pedestal, the internal space being adapted for receiving the autonomous cash box of claim 15; and a payment interface mounted on top of the pedestal and adapted for receiving a cash payment;

wherein the payment interface and the internal space of the pedestal are sized and configured so that the cash payment received at the payment interface falls into the open top portion of the autonomous cash box when received in the pedestal.

19. The payment terminal of claim 18, further comprising:

a door position detector;

a wireless transmitter; and a controller operatively connected to the door position detector and to the wireless transmitter, the controller being configured to cause the wireless transmitter to transmit the wireless command to close the autonomous cash box when detecting an opening of the door and to transmit the wireless command to open the autonomous cash box when detecting a closing of the door.

20. A payment terminal comprising:

a pedestal having a door giving access to an internal space of the pedestal, the internal space being adapted for receiving the autonomous cash box of claim 1; and a payment interface mounted on top of the pedestal and adapted for receiving a cash payment;

wherein the payment interface and the internal space of the pedestal are sized and configured so that the cash payment received at the payment interface falls into the open top portion of the autonomous cash box when received in the pedestal.

* * * * *